US008056843B2

(12) United States Patent
Evans et al.

(10) Patent No.: US 8,056,843 B2
(45) Date of Patent: Nov. 15, 2011

(54) BLOWING WOOL MACHINE OUTLET PLATE ASSEMBLY

(75) Inventors: Michael E. Evans, Granville, OH (US); Michael W. Johnson, Lithopolis, OH (US); Christopher M. Relyea, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/889,468

(22) Filed: Sep. 24, 2010

(65) Prior Publication Data

US 2011/0031339 A1 Feb. 10, 2011

Related U.S. Application Data

(63) Continuation of application No. 12/002,643, filed on Dec. 18, 2007, now Pat. No. 7,845,585, which is a continuation-in-part of application No. 11/581,660, filed on Oct. 16, 2006, now Pat. No. 7,712,690.

(51) Int. Cl.
*B02C 23/20* (2006.01)

(52) U.S. Cl. ..... 241/60

(58) Field of Classification Search ..... 241/60, 241/277, 278.1, 278.2, 282, 134, 141, 98, 241/136; 285/242, 255

See application file for complete search history.

(56) References Cited

U.S. PATENT DOCUMENTS 5,317,779 A * 6/1994 Hoagland ..... 15/111
7,845,585 B2 * 12/2010 Evans et al. ..... 241/60

FOREIGN PATENT DOCUMENTS

GB 2124194 A 2/1984

* cited by examiner

*Primary Examiner* — Jimmy T Nguyen
(74) *Attorney, Agent, or Firm* — MacMillan, Sobanski & Todd, LLC

(57) ABSTRACT

A machine for distributing blowing wool from a bag of compressed blowing wool is provided. The machine includes a chute configured to receive the compressed blowing wool and a shredding chamber connected to the chute. The shredding chamber includes a plurality of shredders configured to shred the blowing wool. A discharge mechanism is mounted to receive the shredded and picked apart blowing wool and configured to distribute the blowing wool into an airstream. An outlet plate assembly is mounted to the discharge mechanism and includes an outlet pipe configured to connect a distribution hose to the discharge mechanism. The outlet pipe has a plurality of inner diameters each having an inner surface. A blower is configured to provide the airstream flowing through the discharge mechanism. In an installed position, an outer surface of the distribution hose contacts the inner surface of one of the inner diameters of the outlet pipe.

12 Claims, 5 Drawing Sheets

BLOWING WOOL MACHINE OUTLET PLATE ASSEMBLY

RELATED APPLICATIONS

This application is a continuation patent application of U.S. patent application Ser. No. 12/002,643, filed Dec. 18, 2007, now U.S. Pat. No. 7,845,585, which was a continuation-in-part patent application of U.S. patent application Ser. No. 11/581,660, filed Oct. 16, 2006, now U.S. Pat. No. 7,712,690, the disclosures of which are incorporated herein by reference.

TECHNICAL FIELD

This invention relates to loosefill insulation for insulating buildings. More particularly this invention relates to machines for distributing packaged loosefill insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if blowing wool machines could be improved to make them easier to use.

SUMMARY OF THE INVENTION

According to this invention there is provided a machine for distributing blowing wool from a bag of compressed blowing wool. The machine includes a chute configured to receive the compressed blowing wool and a shredding chamber connected to the chute. The shredding chamber includes a plurality of shredders configured to shred and pick apart the blowing wool. A discharge mechanism is mounted to receive the shredded and picked apart blowing wool and configured to distribute the blowing wool into an airstream. An outlet plate assembly is mounted to the discharge mechanism and includes an outlet pipe configured to connect a distribution hose to the discharge mechanism. The outlet pipe has a plurality of inner diameters each having an inner surface. A blower is configured to provide the airstream flowing through the discharge mechanism and the outlet plate assembly. In an installed position, an outer surface of the distribution hose contacts the inner surface of one of the inner diameters of the outlet pipe.

According to this invention there is also provided a machine for distributing blowing wool from a bag of compressed blowing wool. The machine includes a shredding chamber including a plurality of shredders configured to shred and pick apart the blowing wool. A discharge mechanism is mounted to the shredding chamber and configured to distribute the blowing wool into an airstream. An outlet plate assembly is mounted at an outlet end of the discharge mechanism, the outlet plate assembly having at least one outlet pipe. The outlet pipe has a plurality of inner diameters configured to receive distribution hoses of different size diameters. The outlet pipe is fastened to the outlet plate assembly by a retention member having an end section configured to seat against a hose end of the outlet pipe. A blower is configured to provide the airstream flowing through the discharge mechanism and the outlet plate assembly. The retention member is configured to fasten and unfasten the outlet pipe to the outlet plate assembly without the use of special tools.

Various objects and advantages of this invention will become apparent to those skilled in the art from the following detailed description of the invention, when read in light of the accompanying drawings.

DETAILED DESCRIPTION OF THE INVENTION

Figure 1:
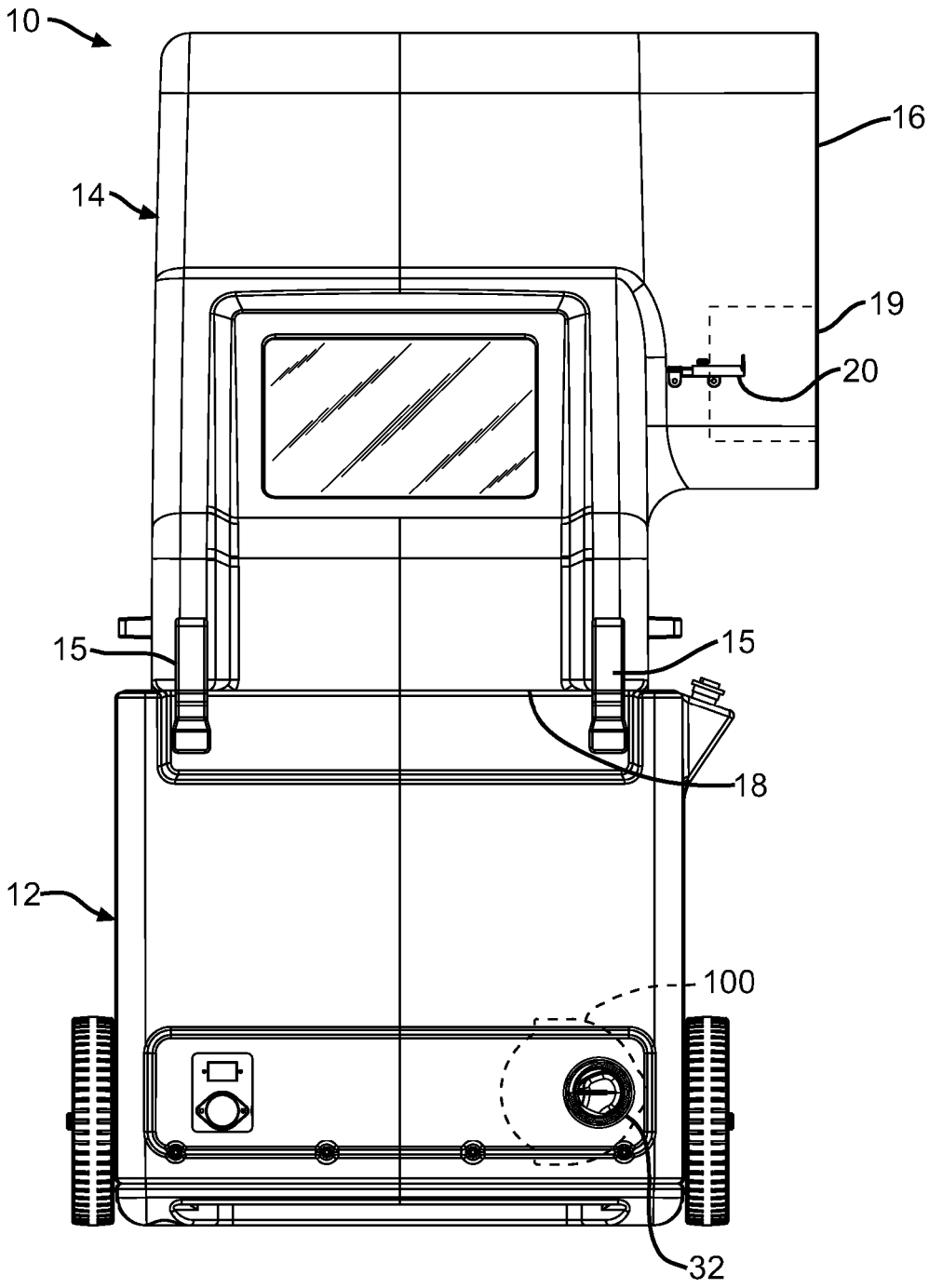
FIG. 1 is a front view in elevation of an insulation blowing wool machine.
Figure 2:
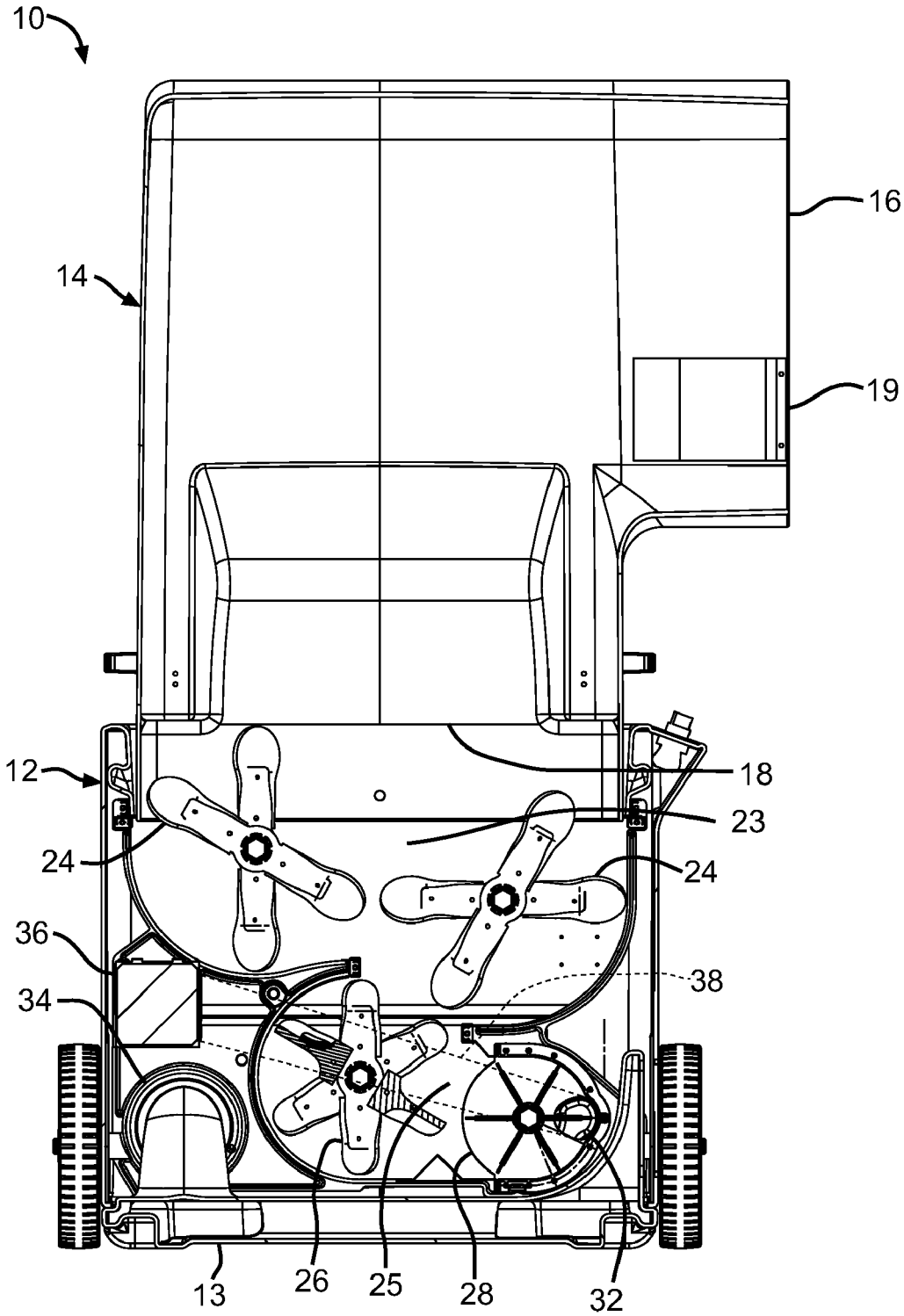
FIG. 2 is a front view in elevation, partially in cross-section, of the insulation blowing wool machine of FIG. 1.
Figure 3:
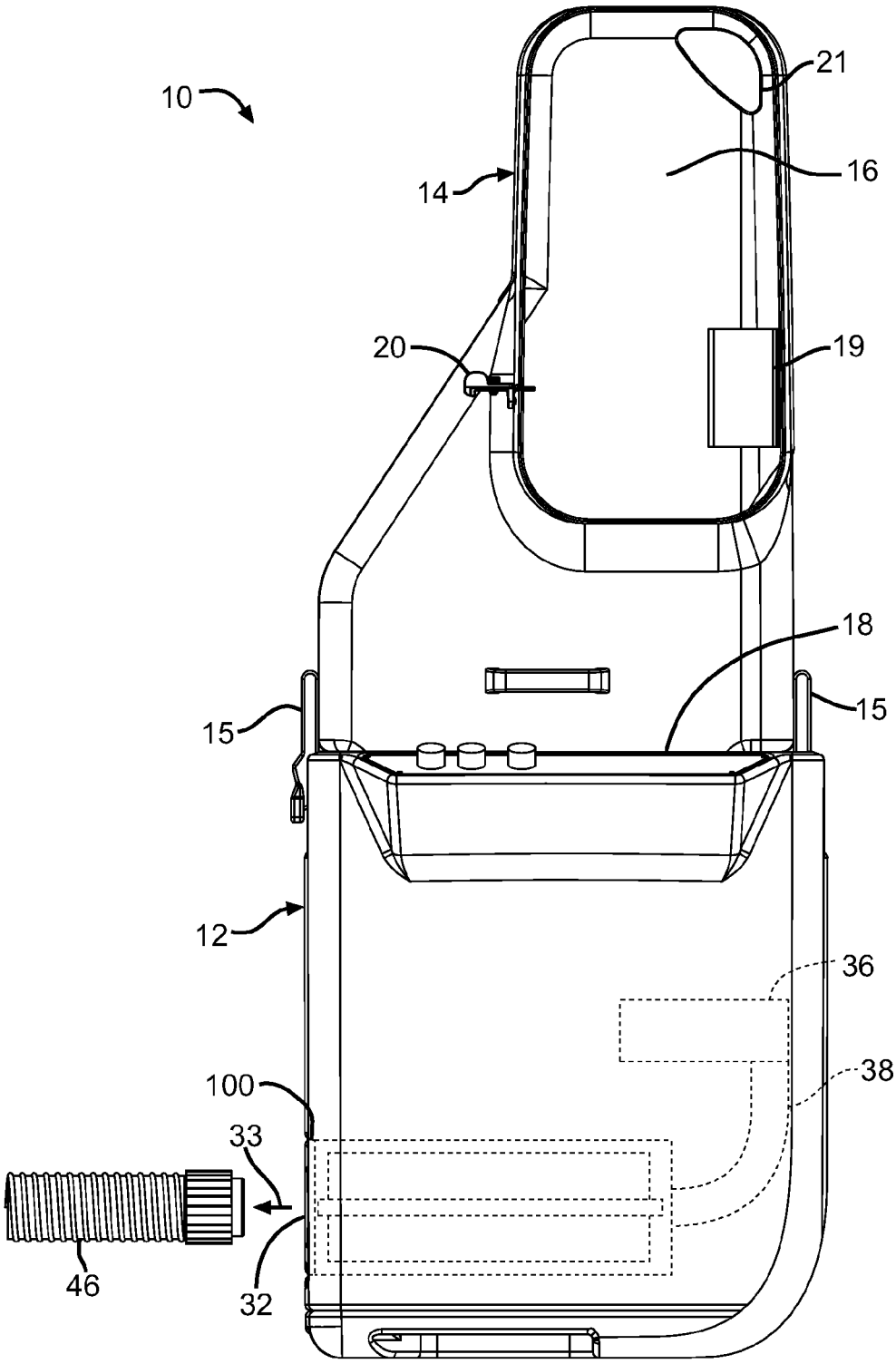
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to the shredding chamber 23 as shown in FIG. 2. Optionally, the chute 14 includes a handle segment 21, as shown in FIG. 3, to facilitate ready movement of the blowing wool machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing wool against a cutting mechanism 20, shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24 and an agitator 26. The low speed shredders 24 shred and pick apart the blowing wool as the blowing wool is discharged from the outlet end 18 of the chute 14 into the lower unit 12. Although the blowing wool machine 10 is shown with a plurality of low speed shredders 24, any type of separator, such as a clump breaker, beater bar or any other mechanism that shreds and picks apart the blowing wool can be used.

As further shown in FIG. 2, the shredding chamber 23 includes an agitator 26 for final shredding of the blowing wool and for preparing the blowing wool for distribution into an airstream. In this embodiment as shown in FIG. 2, the agitator 26 is positioned beneath the low speed shredders 24. Alternatively, the agitator 26 can be disposed in any location relative to the low speed shredders 24, such as horizontally adjacent to the shredders 24, sufficient to receive the blowing wool from the low speed shredders 24. In this embodiment, the agitator 26 is a high speed shredder. Alternatively, any type of shredder can be used, such as a low speed shredder, clump breaker, beater bar or any other mechanism that finely shreds the blowing wool and prepares the blowing wool for distribution into an airstream.

In this embodiment, the low speed shredders 24 rotate at a lower speed than the agitator 26. The low speed shredders 24 rotate at a speed of about 40-80 rpm and the agitator 26 rotates at a speed of about 300-500 rpm. In another embodiment, the low speed shredders 24 can rotate at speeds less than or more than 40-80 rpm and the agitator 26 can rotate at speeds less than or more than 300-500 rpm.

Referring again to FIG. 2, a discharge mechanism 28 is positioned adjacent to the agitator 26 and is configured to distribute the finely shredded blowing wool into the airstream. In this embodiment, the shredded blowing wool is driven through the discharge mechanism 28 and through a machine outlet 32 by an airstream provided by a blower 36 mounted in the lower unit 12. The airstream is indicated by an arrow 33 in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38 as shown in FIG. 2. Alternatively, the airstream 33 can be provided to the discharge mechanism 28 by another structure, such as by a hose or pipe, sufficient to provide the discharge mechanism 28 with the airstream 33.

The shredders 24, agitator 26, discharge mechanism 28 and the blower 36 are mounted for rotation. They can be driven by any suitable means, such as by a motor 34, or other means sufficient to drive rotary equipment. Alternatively, each of the shredders 24, agitator 26, discharge mechanism 28 and the blower 36 can be provided with its own motor.

In operation, the chute 14 guides the blowing wool to the shredding chamber 23. The shredding chamber 23 includes the low speed shredders 24 which shred and pick apart the blowing wool. The shredded blowing wool drops from the low speed shredders 24 into the agitator 26. The agitator 26 prepares the blowing wool for distribution into the airstream 33 by further shredding the blowing wool. The finely shredded blowing wool exits the agitator 26 at an outlet end 25 of the shredding chamber 23 and enters the discharge mechanism 28 for distribution into the airstream 33 provided by the blower 36. The airstream 33, with the shredded blowing wool, exits the machine 10 at the machine outlet 32 and flows through the distribution hose 46, as shown in FIG. 3, toward the insulation cavity, not shown.

Figure 4:
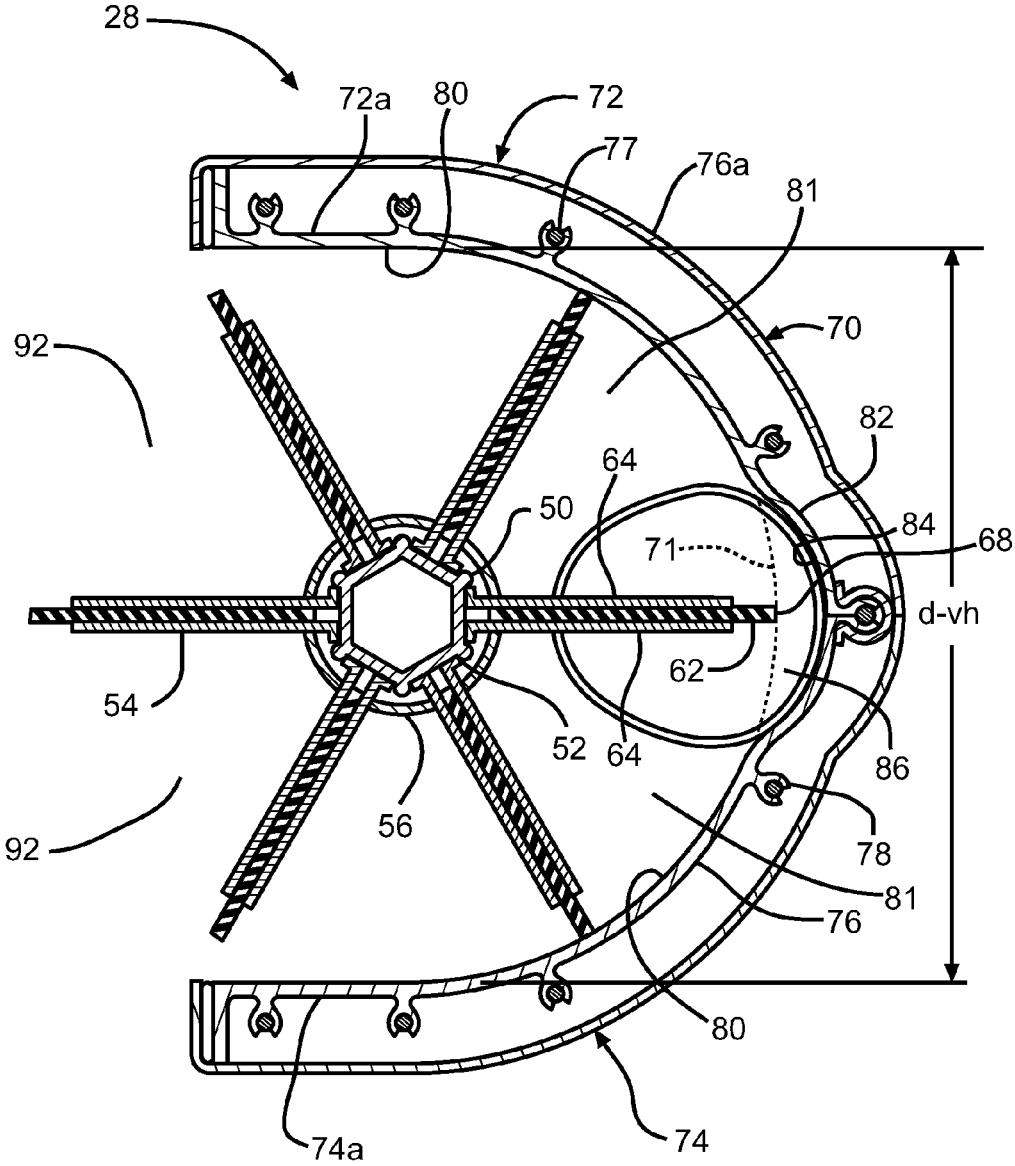
FIG. 4 is a cross-sectional view in elevation of a discharge mechanism of the insulation blowing wool machine of FIG. 1.

As previously discussed and as shown in FIG. 4, the discharge mechanism 28 is configured to distribute the finely shredded blowing wool into the airstream 33. In this embodiment, the discharge mechanism 28 is a rotary valve. Alternatively the discharge mechanism 28 can be any other mechanism including staging hoppers, metering devices, rotary feeders, sufficient to distribute the shredded blowing wool into the airstream 33.

As shown in FIG. 4, the discharge mechanism 28 includes a valve shaft 50 mounted for rotation. In this embodiment, the valve shaft 50 is a hollow rod having a hexagonal cross-sectional shape. The valve shaft 50 is configured with flat hexagonal surfaces 52 which are used to seat a plurality of sealing vane assemblies 54. Alternatively, other cross-sectional shapes, such as a pentagonal cross-sectional shape, can be used.

In this embodiment the valve shaft 50 is made of steel, although the valve shaft 50 can be made of other materials, such as aluminum or plastic, or other materials sufficient to allow the valve shaft 50 to rotate with the seated sealing vane assemblies 54.

As shown in FIG. 4, the plurality of sealing vane assemblies 54 are positioned against the flat hexagonal surface 52 of the valve shaft 50 and held in place by a shaft lock 56. The sealing vane assemblies 54 include a sealing core 62 disposed between two opposing vane supports 64. The sealing core 62 includes a vane tip 68 positioned at the outward end of the sealing core 62. As shown in FIG. 4, the sealing vane assembly 54 is configured such that the vane tip 68 seals against a valve housing 70 as the sealing vane assembly 54 rotates within the valve housing 70. In this embodiment, the sealing core 62 is made from fiber-reinforced rubber. In another embodiment, the sealing core 62 can be made of other materials, such as polymer, silicone, felt, or other materials sufficient to seal against the valve housing 70. In this embodiment, the fiber-reinforced sealing core 62 has a hardness rating of about 50 A to 70 A as measured by a Durometer. The hardness rating of about 50 A to 70 A allows the sealing core 62 to efficiently seal against the valve housing 70 as the sealing vane assembly 54 rotates within the valve housing 70.

Referring again to FIG. 4, the sealing vane assemblies 54, attached to the valve shaft 50 by the shaft lock 56, rotate within the valve housing 70. In this embodiment, the valve housing 70 is made from an aluminum extrusion, although the valve housing 70 can be made from other materials, including brass or plastic, sufficient to form a housing within which sealing vane assemblies 54 rotate. In this embodiment as shown in FIG. 4, the valve housing 70 includes a top housing segment 72 and a bottom housing segment 74. In another embodiment, the valve housing 70 can be made of a single segment or the valve housing 70 can be made of more than two segments.

As shown in FIG. 4, the valve housing includes an inner housing wall 76 and an optional outer housing wall **76*a*. The inner housing wall 76 has an inner housing surface 80. In this embodiment, the inner housing surface 80 is coated with a chromium alloy to provide a low friction and extended wear surface. Alternatively, the inner housing surface 80 may not be coated with a low friction and extended wear surface or the inner housing surface 80** may be coated with other materials, such as a nickel alloy, sufficient to provide a low friction, extended wear surface.

The top housing segment 72 and the bottom housing segment 74 are attached to the lower unit 12 by housing fasteners 78. In this embodiment, the housing fasteners 78 are bolts extending through mounting holes 77 disposed in the top housing segment 72 and the bottom housing segment 74. In another embodiment, the top housing segment 72 and the bottom housing segment 74 can be attached to the lower unit 12 by other mechanical fasteners, such as clips or clamps, or by other fastening methods including sonic welding or adhesive.

In this embodiment as shown in FIG. 4, the valve housing 70 is curved and extends to form an approximate semi-circular shape. The semi-circular shape of the valve housing 70 has an approximate inside diameter d-vh which is approximately the same diameter of an arc 71 formed by the vane tips 68 of the rotating sealing vane assemblies 54. In operation, the vane tips 68 of the sealing vane assemblies 54 seal against the inner housing surface 80 such that finely shredded blowing wool entering the discharge mechanism 28 is contained within a wedge-shaped space 81 defined by adjacent sealing vane assemblies 54 and the inner housing surface 80.

As shown in FIG. 4, the valve housing 70 includes an eccentric segment 82. The eccentric segment 82 extends from or bulges out from the semi-circular shape of the top housing segment 72 and the bottom housing segment 74. In this embodiment, the eccentric segment 82 has an approximate cross-sectional shape of a dome. Alternatively, the eccentric segment 82 can have any cross-section shape that extends from the top housing segment 72 and the bottom housing segment 74. The eccentric segment 82 includes an inner eccentric surface 84. As shown in FIG. 4, the eccentric segment 82 forms an eccentric region 86 which is defined as the area bounded by the inner eccentric surface 84 and the arc 71 formed by the vane tips 68 of the rotating sealing vane assemblies 54. The eccentric region 86 is within the airstream 33 flowing through the discharge mechanism 28. In operation, as a sealing vane assembly 54 rotates into the airstream 33, the vane tip 68 of the sealing vane assembly 54 becomes spaced apart from the inner housing surface 80 of the valve housing 70. As the sealing vane assembly 54 further rotates within the eccentric region 86, the airstream 33 flows along the vane tip 68, thereby forcing any particles of blowing wool caught on the vane tip 68 to be blown off. This clearing of the sealing vane assembly 54 prevents a buildup of shredded blowing wool from forming on the sealing vane assembly 54.

Referring again to FIG. 4, the top and bottom housing segments 72 and 74 do not completely enclose the valve housing 70, and valve housing 70 includes a side inlet 92. In this embodiment, the side inlet 92 of the valve housing 70 has an approximate length equal to the diameter d-vh of the valve housing 70. Alternatively, the side inlet 92 of the valve housing 70 can have an approximate length that is more or less than the diameter d-vh of the valve housing 70.

In this embodiment as further shown in FIG. 4, the top housing segment 72 and the bottom housing segment 74 have optional straight portions 72*a* and 74*a* respectively, extending from the curved portions of the top and bottom housing segments 72 and 74. The straight portions 72*a* and 74*a* are configured such that as the sealing vane assemblies 54 rotate, the vane tips 68 are spaced apart from the straight portions 72*a* and 74*a*. In another embodiment, the top and bottom housing segments 72 and 74 can have extended segments configured in another shape, such as an outwardly extending arc, sufficient to be spaced apart from the vane tips 68 as the sealing vane assemblies 54 rotate.

As previously discussed and as further shown in FIG. 4, the top and bottom housing segments 72 and 74 do not completely enclose the valve housing 70 and the valve housing 70 includes a side inlet 92. The side inlet 92 is configured to receive the finely shredded blowing wool as it is fed from the agitator 26. Positioning the side inlet 92 of the discharge mechanism 28 at the side of the discharge mechanism 28 allows finely shredded blowing wool to be fed approximately horizontally into the discharge mechanism 28. Horizontal feeding of the blowing wool from the agitator 26 to the discharge mechanism 28 is defined to include the feeding of blowing wool in a direction that is substantially parallel to a floor 13 of the lower unit 12 as best shown in FIG. 2. Feeding finely shredded blowing wool horizontally into the discharge mechanism 28 allows the discharge mechanism 28 to be positioned at a lower location within the lower unit 12, thereby allowing the blowing wool machine 10 to be more compact. In this embodiment, the agitator 26 is positioned to be adjacent to the side inlet 92 of the discharge mechanism 28. In another embodiment, a low speed shredder 24, or a plurality of shredders 24 or agitators 26, or another mechanism can be adjacent to the side inlet 92, such that finely shredded blowing wool is fed horizontally into the side inlet 92.

While the preceding description describes one example of a blowing wool machine, it should be understood that any type of blowing wool machine, sufficient to prepare and distribute blowing wool into an airstream can be used.

As best shown in FIG. 1, the discharge mechanism 28 further includes an outlet plate assembly 100. The outlet plate assembly 100 is positioned at the machine outlet 32 and is configured to substantially cover the outlet end of the discharge mechanism 28. The outlet plate assembly 100 is further configured to connect the distribution hose 46 to the discharge mechanism 28.

Figure 5:
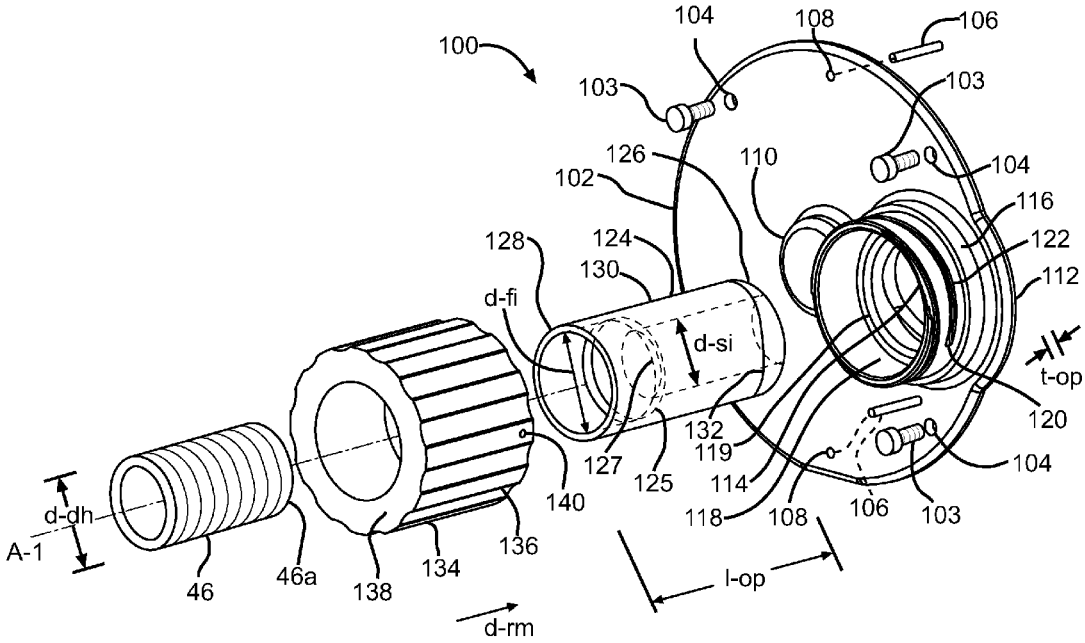
FIG. 5 is a perspective exploded view of an outlet plate assembly of the insulation blowing wool machine of FIG. 1.

As shown in FIG. 5, the outlet plate assembly 100 includes an outlet plate 102. The outlet plate 102 is configured to substantially cover the outlet end of the discharge mechanism 28. In the illustrated embodiment, the outlet plate 102 is made from aluminum, although the outlet plate 102 can be made from other materials, including brass or plastic, sufficient to substantially cover the outlet end of the discharge mechanism 28.

As shown in FIG. 5, the outlet plate 102 has a thickness t-op. In the illustrated embodiment, the thickness t-op is approximately 0.25 inches. In another embodiment, the thickness t-op can be more or less than 0.25 inches.

The outlet plate 102 is attached to the discharge mechanism 28 by outlet plate fasteners 103. In the illustrated embodiment, the outlet plate fasteners 103 are bolts extending through a plurality of outlet plate mounting holes 104 disposed in the outlet plate 102. In the illustrated embodiment, the outlet plate fasteners 103 have a diameter of approximately 0.25 inches. In another embodiment, the outlet plate fasteners 103 can have a diameter of larger or smaller than 0.25 inches. While the illustrated embodiment shows three outlet plate fasteners 103, it should be understood that any number of outlet plate fasteners 103, sufficient to attach the outlet plate 102 to the discharge mechanism 28, can be used. In yet another embodiment, the outlet plate 102 can be attached to the discharge mechanism 28 by other mechanical fasteners, such as clips or clamps.

The outlet plate 102 includes at least one positioning pin 106. The positioning pins 106 are configured to position the outlet plate 102 on the discharge mechanism 28. The positioning pins 106 are disposed in a mounting hole 108. The positioning pins 106 are configured to align the outlet plate 102 to the discharge mechanism 28 by insertion of the positioning pins 106 into corresponding mounting holes (not shown) in the discharge mechanism 28. While the illustrated embodiment shows two positioning pins 106, it should be understood that any number of positioning pins, sufficient to align the outlet plate 102 to the discharge mechanism 28, can be used.

In the illustrated embodiment, the positioning pins 106 are a steel roll pin having an outside diameter of approximately 0.125 inches. In another embodiment, the positioning pins 106 can be made of other materials sufficient to align the outlet plate 102 to the discharge mechanism 28. In yet another embodiment, the positioning pins 106 can have an outside diameter that is larger or smaller than 0.125 inches. In yet another embodiment, the outlet plate 102 can be aligned with the discharge mechanism 28 by other aligning mechanisms, such as for example mating teeth and notches.

Referring again to FIG. 5, the outlet plate 102 includes a bearing pocket 110. The bearing pocket 110 is configured to contain a bearing (not shown). The bearing supports one end of the rotating valve shaft 50. In the illustrated embodiment, the bearing is a self-contained ball bearing. In another embodiment, the bearing can be other bearing types, such as for example roller bearings or sleeve bearings, sufficient to support one end of the rotating valve shaft 50. As shown in FIG. 5, the bearing pocket 110 is positioned approximately in the center of the outlet plate 102. In another embodiment, the bearing pocket 110 can be positioned elsewhere in the outlet plate 102.

Referring again to FIG. 5, the outlet plate 102 includes an outlet plate eccentric region, indicated generally at 112. The outlet plate eccentric region 112 is configured to cover the eccentric segment 82 of the discharge mechanism 28.

As shown in FIG. 5, the outlet plate 102 includes an airstream opening 114. In the illustrated embodiment, the airstream opening 114 is configured to include the eccentric region 86 of the discharge mechanism 28. In another embodiment, the airstream opening 114 can be any shape sufficient to discharge shredded blowing wool from the discharge mechanism 28.

As shown in FIG. 5, the outlet plate 102 includes a support 116. In the illustrated embodiment, the support 116 is hollow and has an inner surface 118, an inner shoulder 119 and an outer surface 120. The support 116 is positioned on the outlet plate 102 such that discharged shredded blowing wool flows from the discharge mechanism 28 through the airstream opening 114 and through the support 116. In the illustrated embodiment, the support 116 is made of aluminum. In another embodiment, the support 116 can be other materials, such as plastic or brass. In the illustrated embodiment, the support 116 is attached to the outlet plate 102 by sonic welding. In another embodiment, the support 116 can be attached to the outlet plate 102 by other mechanisms, such as for example clips, clamps or adhesive.

As shown in FIG. 5, the inner surface 118 of the support 116 has a smooth finish. The smooth finish of the inner surface 118 is configured to facilitate the flow of discharged shredded blowing wool. In another embodiment, the inner surface 118 can have another finish, such as for example a coating of anti-friction material, sufficient to facilitate the flow of discharged shredded blowing wool.

Referring again to FIG. 5, the outer surface 120 of the support 116 includes a first fastening portion 122. The first fastening portion 122 will be described in more detail below.

As shown in FIG. 5, the outlet plate assembly 100 includes an outlet pipe 124. The outlet pipe 124 is hollow and is configured to connect the distribution hose 46 to the outlet plate assembly 100. The outlet pipe 124 has a plate end 126, a hose end 128 and an outer surface 130. As shown in FIG. 5, the outlet pipe 124 has a member 132 arranged circumferentially about the outer surface 130 at the plate end 126. The member 132 is configured to seat against the inner shoulder 119 of the support 116 when the outlet pipe 124 is inserted into the support 116. In the illustrated embodiment, the member 132 is created from a snap ring. In another embodiment, the member 132 can be created from other structures, such as for example a clip, rib or clamp, sufficient to seat against the inner shoulder 119 of the support 116.

As shown in FIG. 5, the outlet pipe 124 has a length l-op. In the illustrated embodiment, the length l-op of the outlet pipe 124 is approximately 6 inches. Alternatively, the length l-op can be more or less than 6 inches.

As shown in FIG. 5, the outlet pipe has a first inner diameter d-fi and a second inner diameter d-si. In the illustrated embodiment, the first inner diameter d-fi extends approximately half of the length l-op of the outlet pipe 124 and the second inner diameter d-si extends the remaining length l-op of the outlet pipe 124. In another embodiment, the first inner diameter d-fi can extend more or less than approximately half of the length l-op of the outlet pipe 124.

As shown in FIG. 5, the first inner diameter d-fi of the outlet pipe 124 is configured to support a distribution hose 46 having a corresponding outer diameter d-dh. In the illustrated embodiment, the first inner diameter d-fi of the outlet pipe 124 is approximately 2.5 inches and is configured to support a distribution hose 46 having an outer diameter d-dh of approximately 2.5 inches. In another embodiment, the first inner diameter d-fi of the outlet pipe 124 can be another size sufficient to support a mating distribution hose 46. In operation, a first end 46*a* of the distribution hose 46 is inserted into the hose end 128 of the outlet pipe 124 until the first end 46*a* seats against a shoulder 125 created by the second inner diameter d-si. The first end 46*a* of the distribution hose 46 is retained within the outlet pipe 124 by a retaining mechanism 127. In the illustrated embodiment, the retaining mechanism 127 is a clamp. Alternatively the retaining mechanism 127 can be other mechanisms, such as for example clips, sufficient to retain the first end 46*a* of the distribution hose 46 within the outlet pipe 124. In another embodiment, the first end 46*a* of the distribution hose 46 can be retained within the outlet pipe 124 by other mechanisms, such as for example clips. Seating of the first end 46*a* of the distribution hose 46 against the shoulder 125 of the outlet pipe 124 creates a smooth transition to facilitate the flow of blowing wool discharged by the discharge mechanism 28. The term "smooth transition" as used herein, is defined to include structures facilitating the flow of blowing wool and providing a sealing function. In the illustrated embodiment, the seating of the first end 46*a* of the distribution hose 46 against the shoulder 125 seals that portion of the path of the blowing wool. In another embodiment, the first end 46*a* of the distribution hose 46 can be sealed against the shoulder 125 using other mechanisms, such as for example sealing gaskets.

The use of a distribution hose 46 having an outer diameter d-dh of approximately 2 inches operates in a similar manner. The second inner diameter d-si of the outlet pipe 124 is configured to support a distribution hose 46 having a corresponding outer diameter d-dh. In the illustrated embodiment, the second inner diameter d-si of the outlet pipe 124 is approximately 2.0 inches and is configured to support a distribution hose 46 having an outer diameter d-dh of approximately 2.0 inches. In another embodiment, the second inner diameter d-si of the outlet pipe 124 can be another size sufficient to support a mating distribution hose 46. In operation, a first end 46*a* of the distribution hose 46 is inserted into the hose end 128 of the outlet pipe 124 until the first end 46*a* seats within the second inner diameter d-si. The first end 46*a* of the distribution hose 46 is retained within the outlet pipe 124 by the same mechanism previously discussed. Seating of the first end 46*a* of the distribution hose 46 against the second inner diameter d-si of the outlet pipe 124 creates a smooth transition to facilitate the flow of blowing wool discharged by the discharge mechanism 28.

The outlet plate assembly 100 includes a retention member 134. The retention member 134 includes a second fastening portion (not shown), a grip surface 136 and an end section 138. In general, the retention member 134 is configured to fasten the outlet pipe 124 to the support 116. The second fastening portion of the retention member 134 has at least one fastening pin 140. The fastening pin 140 is configured to engage the first fastening portion 122 on the support 116. In the illustrated embodiment, the fastening pin 140 is a steel pin extending inward toward the center of the retention member 134 and having a flat bottom (not shown). In another embodiment, the fastening pin 140 can be another structure or mechanism sufficient to engage the first fastening portion 122.

In the embodiment shown in FIG. 5, the first fastening portion 122 is a double start thread having a square thread bottom. In another embodiment, the first fastening portion 122 can have another configuration. In operation, as the retention member 134 is rotated about axis A-1, the fastening pin 140 engages and follows the double start thread. As the fastening pin 140 follows the thread, the retention member 134 is moved in direction d-rm. The retention member 134 continues to move in direction d-rm until the end section 138 of the retention member 134 seats against the substantially flat surface at the hose end 128 of the outlet pipe. In this position, the retention member 134 fastens the outlet pipe 124 to the support 116. In another embodiment, the retention member 134 can fasten the outlet pipe 124 to the support with other mechanisms, such as for example clips or clamps. While the embodiment shown in FIG. 5 illustrates one fastening pin 140, it should be understood that any number of fastening pins can be used.

As shown in FIG. 5, the retention member 134 includes grip surface 136. The grip surface 136 is configured to allow the machine 10 user to grip and rotate the retention member 134 by hand and without the use of special tools. While the grip surface 136 of the retention member 136 is shown having a plurality of grooves, it should be understood that the grip surface can have any configuration sufficient to allow the machine user to grip and rotate the retention member 134 by hand and without the use of special tools. In the illustrated embodiment, the retention member 134 is made of aluminum. Alternatively, the retention member 134 can be made of suitable other materials, such as for example brass or plastic.

As mentioned above, the outlet plate assembly 100 is configured to allow a machine user to quickly change the size of the distribution hose 46 by hand and without the use of special tools. The illustrated configuration of the outlet plate assembly 100 also allows various types of loosefill nodules to be efficiently distributed since various outlet pipes 124 and distribution hoses 46 can be quickly connected as needed, thereby reducing machine set-up time. Additionally, the machine user is not required to be specially trained to change the outlet pipes 124 and distribution hoses 46.

Finally, as the smooth transition from the discharge mechanism 28 to the distribution hose 46 can prevent blockages of the blowing wool, the outlet plate assembly enables a smooth transition to various sizes of distribution hoses 46 without jamming of the blowing wool.

While the embodiment of the outlet pipe 124 shown in FIG. 5 illustrates two inner diameters, it should be understood that the outlet pipe 124 can have more or less than two inner diameters.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine for distributing blowing wool from a bag of compressed blowing wool, the machine comprising:

a chute configured to receive the compressed blowing wool;

a shredding chamber connected to the chute and including a plurality of shredders configured to shred and pick apart the blowing wool;

a discharge mechanism mounted to receive the shredded and picked apart blowing wool and configured to distribute the blowing wool into an airstream;

an outlet plate assembly mounted to the discharge mechanism, the outlet plate assembly including an outlet pipe configured to connect a distribution hose to the discharge mechanism, the outlet pipe having a plurality of inner diameters each having an inner surface; and a blower configured to provide the airstream flowing through the discharge mechanism and the outlet plate assembly;

wherein the outlet plate assembly includes a support, the support having an inner shoulder formed within a hollow interior portion and a threaded exterior surface, wherein a plate end of the outlet pipe has a member arranged circumferentially about an exterior surface and configured to seat against the inner shoulder of the support when the outlet pipe is inserted into the support, and wherein in an installed position, an outer surface of the distribution hose contacts the inner surface of one of the inner diameters of the outlet pipe.

2. The machine of claim 1, wherein the member is a snap ring.

3. The machine of claim 1, wherein the outlet pipe includes a shoulder formed within the outlet pipe and further formed from a reduced inner diameter.

4. The machine of claim 3, wherein the shoulder is configured as a seat for one end of the distribution hose.

5. The machine of claim 1, wherein one of the inner diameters of the outlet pipe is approximately 2.5 inches.

6. The machine of claim 1, wherein the outlet plate assembly includes an outlet plate, wherein the outlet plate is positioned on the discharge mechanism by a plurality of positioning pins and attached to the discharge mechanism by a plurality of outlet plate fasteners.

7. The machine of claim 6, wherein the outlet plate includes a bearing pocket configured to contain a bearing supporting one end of a rotating valve shaft.

8. A machine for distributing blowing wool from a bag of compressed blowing wool, the machine comprising:

a shredding chamber including a plurality of shredders configured to shred and pick apart the blowing wool; a discharge mechanism mounted to the shredding chamber and configured to distribute the blowing wool into an airstream;

an outlet plate assembly mounted at an outlet end of the discharge mechanism, the outlet plate assembly having at least one outlet pipe, the outlet pipe having a plurality of inner diameters configured to receive distribution hoses of different size diameters, the outlet pipe inserted into a support of the outlet plate assembly and fastened to the outlet plate assembly by a retention member, the retention member having an end section configured to seat against a hose end of the outlet pipe; and a blower configured to provide the airstream flowing through the discharge mechanism and the outlet plate assembly;

wherein the retention member is configured to fasten and unfasten the outlet pipe to the outlet plate assembly without the use of special tools, wherein the end section of the retention member has an inner diameter that is less than the outer diameter of a hose end of the outlet pipe, and wherein the end section of the retention member seats against a substantially flat surface at the hose end of the outlet pipe.

9. The machine of claim 8, wherein the retention member has a grip surface configured to allow a machine user to grip and rotate the retention member.

10. The machine of claim 9, wherein the grip surface includes a plurality of grooves extending along the length of the retention member.

11. The machine of claim 8, wherein the retention member has a hollow interior portion and is configured to allow the distribution hose to pass through the hollow interior portion.

12. The machine of claim 8, wherein in an installed position the outlet pipe is positioned within the retention member.

* * * * *